United States Patent [19]

Elsasser

[11] Patent Number: 4,856,239

[45] Date of Patent: Aug. 15, 1989

[54] WINDOW FRAME MEMBER OR RIGID PLASTICS MATERIAL

[75] Inventor: Glenn R. Elsasser, Winnipeg, Canada

[73] Assignee: Western Profiles Limited, Winnipeg, Canada

[21] Appl. No.: 166,126

[22] Filed: Mar. 9, 1988

[30] Foreign Application Priority Data

Mar. 17, 1987 [CA] Canada ..... 532218

[51] Int. Cl.[4] ..... E04B 1/00

[52] U.S. Cl. ..... 52/98; 52/100; 52/208; 52/765; 52/774

[58] Field of Search ..... 52/765, 656, 773, 774, 52/775, 476, 397, 398, 399, 400, 401, 402, 403, 98, 100, 206, 208; 411/386, 508, 39, 42, 39, 508, 509, 510, 913; 49/464

[56] References Cited

U.S. PATENT DOCUMENTS

| | | | |
|---|---|---|---|
| 3,360,893 | 1/1968 | Wattelez | 52/202 X |
| 3,512,318 | 5/1970 | Turner | 52/62 X |
| 4,015,388 | 4/1977 | Hemminger | 52/773 X |
| 4,330,919 | 5/1982 | Bischlipp et al. | 52/731 X |
| 4,555,884 | 12/1985 | Van Eerden | 52/397 |

*Primary Examiner*—David A. Scherbel
*Assistant Examiner*—Creighton Smith
*Attorney, Agent, or Firm*—Beveridge, DeGrandi & Weilacher

[57] ABSTRACT

A window frame member formed as a hollow extrusion of rigid plastics material has a hollow space partly defined by a wall portion including two opposed, undercut lips and a web interconnecting the lips. Internal grooves are provided along the junctions of the web with the lips to provide lines of severance allowing the web to be readily removed so as to provide a slot between the edges of the lips. Preferably, the web and adjoining parts of the lips have a smooth, uninterrupted exterior surface. This invention allows the frame member to be used either with the web in place, in which case there is no slot or observable discontinuity in the exterior wall, or with the web removed where it is desired to provide a slot for weather stripping or attachment of adjacent pieces. The web may be readily removed with simple tools.

6 Claims, 2 Drawing Sheets

FIG. I

WINDOW FRAME MEMBER OR RIGID PLASTICS MATERIAL

The present invention relates to frame members formed as a hollow extrusion of a rigid plastics material such as polyvinyl chloride, and especially frame members suitable for plastic window frames.

It is known to make window frames largely or entirely of rigid plastics material such as so-called "rigid" or "high impact" polyvinyl chloride, the frames being formed from interconnected hollow extruded frame members. In some window frames it is desired to incorporate slots to receive an additional window frame part such as a weather sealing member, or a projecting part of an auxiliary frame member by which the two frame members may be locked together. Such weather sealing members or auxiliary frame members may be optional, and this fact has led to the production of frame members which are almost identical to each other except that some have slots and some do not. It is of course undesirable to use a slotted frame member if the slot is not be be used, since water may then enter the frame member through the slot; a slot, without any part inserted therein, also weakens the frame. In the past extruders have produced slotted and unslotted frames using different dies, with the need to change dies when changing from one type of extrusion to another.

The present invention allows a single die and a single vacuum sizer to be used to produce a frame member which is unslotted but which has a strip which is removable to provide a slot as required. The dual purpose frame member also reduces inventory required.

In accordance with the present invention, a frame member for window frames, formed as a hollow extrusion of a rigid plastics material, has a hollow space partly defined by a wall portion including two opposed, undercut lips and a web interconnecting the lips, and internal grooves are provided along each junction of the web with the lips to provide lines of severance allowing ready removal of the web to provide a slot between the edges of the lips. The slot may be used to retain an additional window part such as a sealing strip or a projecting rib of an auxiliary frame part. Preferably, the web and adjacent parts of the lips have a smooth, uninterrupted exterior surface so that the presence of the removable web does not detract from the appearance of the frame member.

Figure 1:
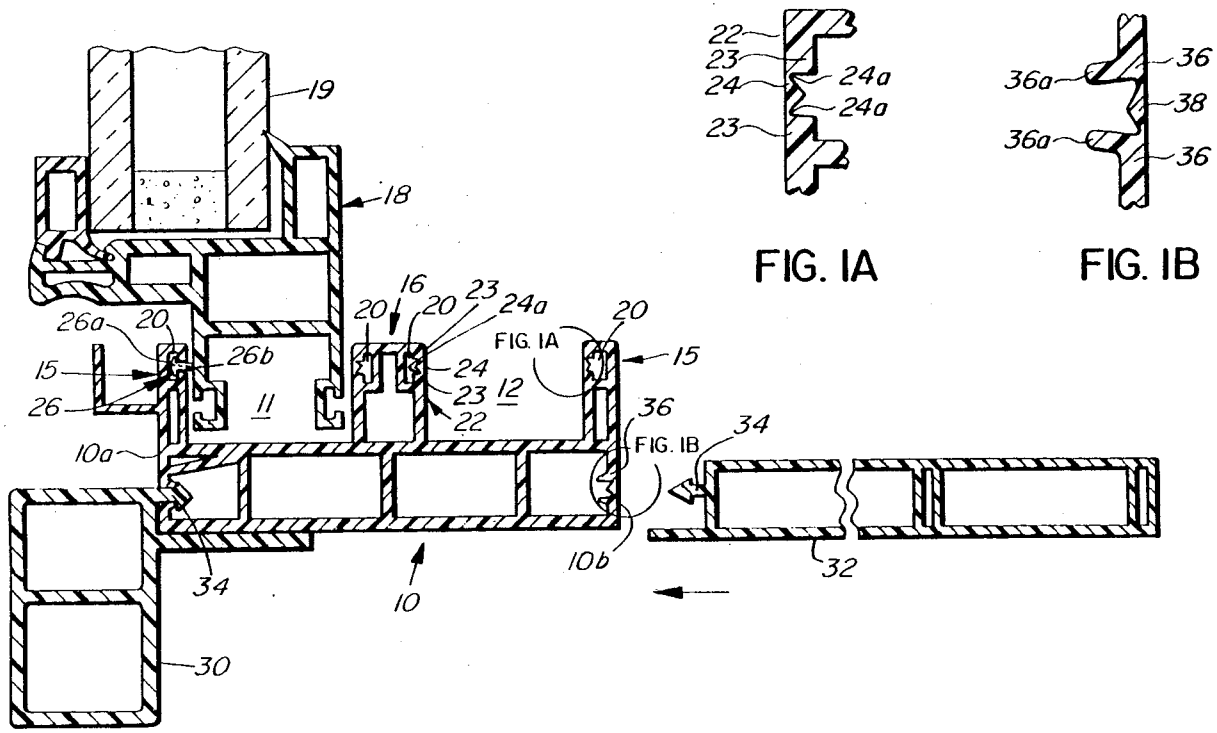
Figure 2:
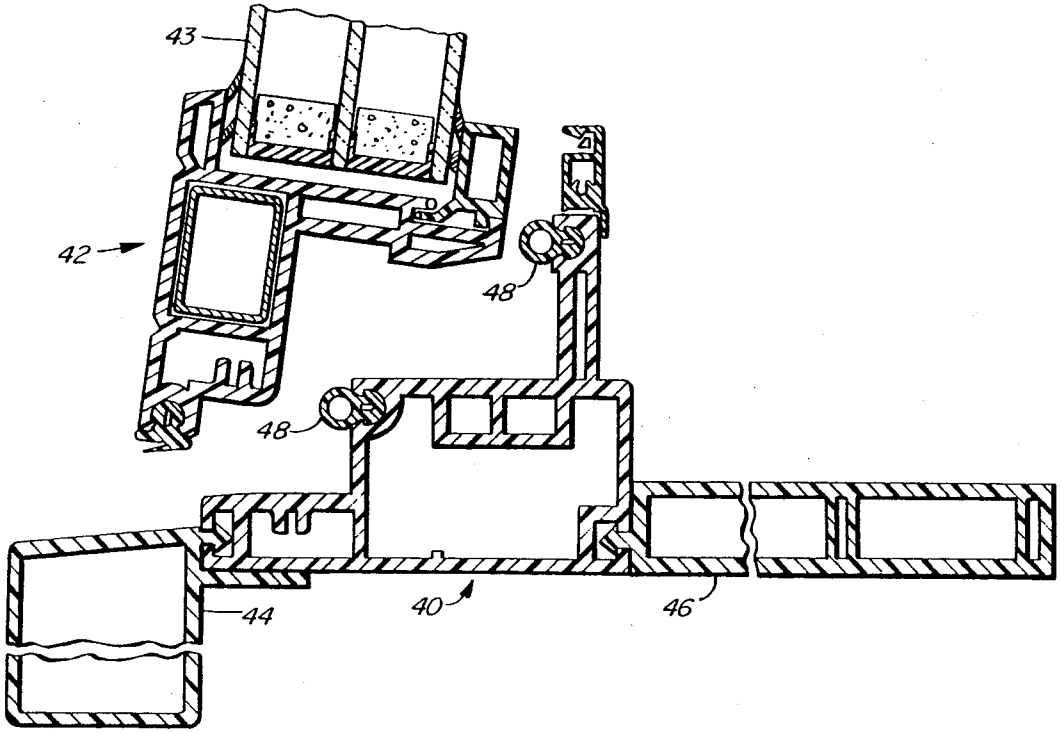

The invention will be described in more detail by reference to the accompanying drawings, in which:

FIG. 1 is a partly assembled, cross-sectional view of three hollow plastic window frame parts of a window frame having sliding sashes (one of which is partly shown), and incorporating the present invention as shown in FIGS. 1A and 1B; and FIG. 2 shows a similar view of the frame parts of a casement window.

In FIG. 1, the main frame member is indicated at 10. This has two channels 11 and 12 defined by front and rear guide parts 15, and a central guide part 16. The channels 11 and 12 receive sashes, one of which is shown at 18, and which are also formed as hollow plastic extrusions; each sash holds a sealed double glazing unit indicated at 19. The sash 18 and glazing unit 19 are conventional. All the frame members are formed of rigid polyvinyl chloride.

Formed in the upper parts of guides 15 and 16, and facing inwardly towards the sashes, are formations in accordance with the present invention. At each of the four locations facing inwardly of the two channels is a hollow space 20 partly defined by an outer wall portion 22 which is part of an inwardly facing side wall of each channel, this wall portion having opposed, undercut lips 23 which are connected by a web 24. The web is of lesser thickness than the walls, and its edges are defined by internal grooves **24*a* which are of such a depth that the thickness of material at the bottom of the grooves is slightly less than one quarter of the wall thickness at the lips. The outer surfaces of the lips and web are coplanar, smooth and uninterrupted when the extrusion is formed so that no interruption in the wall is apparent from the outside. The frame may be used in this way in instances where it is not desired to provide weather stripping at this point. However, if it is desired to provide weather stripping, the webs 22 can readily be removed using a simple tool to apply force to the inside of the web which causes shearing at the bottoms of the grooves 24*a*; the web can then be torn away by hand. Removal of the web, at each location, results in a slot having undercut lips suitable for retaining the base part 26*a* of a weather strip which is indicated at 26 in FIG. 1; this weather strip is conventional having its thin base 26*a* retained in space 20 and having a narrow set of bristles 26*b* which project outwardly through the slot. The weather strip can either be slid into place before the frame members are assembled into a window, or can be inserted after assembly. Preferably, the dimensions of the parts are such that the undercut space inside the lips is at least twice the width of the space between grooves 24*a***.

The side face parts **10*a*, 10*b* of the frame member 10 facing the exterior and interior of the window frame also have formations in accordance with the invention which may be used for attachment of optional auxiliary frame parts 30 and 32. Part 30 is a so-called brick mold which can be attached to the exterior of the frame to create a finished appearance. Part 32 is a so-called jamb extender which is used when the sill width exceeds the width of the window frame, to provide a finished interior appearance. The brick mold 30 is shown in its installed position, while the jamb extender 32 is shown diagrammatically spaced from the part into which it will be fitted. Each of these two parts 30 and 32 have a rib 34** with an arrowhead formation, which is itself conventional, and which is capable of engaging positively within a slot in the frame member.

The present invention provides formations at parts **10*a*, 10*b* which may be left plain or unslotted, or which may provide slots to receive the arrowheads 34. Each part 10*a*, 10*b* includes a hollow space partly defined by lips 36 which terminate in internally extending flanges 36*a* which increase the thickness of material at the edges of the lips. The facing surfaces of flanges 36*a* taper slightly outwardly towards the exterior of the frame member. Adjacent the exterior surface of the frame member the lips are joined by a web 38 which is similar to web 24 previously described, and which is also defined by internal grooves providing lines of severance adjacent the lips 36. Again, the external surface is flat and uninterrupted, so that the frame member can be used in the extruded condition without ingress of moisture and without the presence of any interruption being apparent. If it is decided to use one or both of the auxiliary parts 30 and 32, the appropriate web 38 can be removed by internal pressure applied by a simple tool which severs the web at the base of the grooves. The appropriate arrowhead formation can then be inserted, the arrowhead being gradually compressed as it is pressed through the slot and also bending outwardly the flanges 36***a*, these parts reverting to normal dimensions when the arrowhead has penetrated the slot and anchored itself on the edges of flanges 36*a*. The final position is shown for the brick mold 30.

FIG. 2 shows a cross-sectional view of an extruded plastics window frame 40 for a sash window, the sash being shown at 42 as including a triple glazed sealed unit 43. This window frame has formations at the exterior and interior side faces of the frame for receiving a brick mold 44 and a jamb extender 46 respectively. This frame is molded of somewhat material of such thickness, in relation to the arrowhead formations of parts 44 and 46 that the lips adjacent to the slots are plain and do not require any flanges 36*a* to increase the thickness at this point. Although not shown, slot formations in accordance with the invention may also be used to retain sealing strips 48.

I claim:

1. A window frame member formed as an extrusion of a rigid plastic material, said frame member having a hollow space partly defined by a wall portion including two opposed, undercut lips having inwardly facing surfaces and a web interconnecting said lips and meeting each of said lips at a junction line; and wherein an internal groove is provided along each said junction line of the web with said lips so that said grooves provide lines of severance allowing already removal of the web to provide a slot between the edges of the lips, whereby said inwardly facing surfaces of said undercut lips may be used to retain an additional window frame part, and wherein said web and adjacent parts of said lips have a smooth, uninterrupted exterior surface.

2. A frame member according to claim 1, wherein the width of said hollow space is at least twice the width of the space between said grooves.

3. A frame member according to claim 1, wherein lips are provided with interiorly extending flanges to effectively increase the thickness at the edges of the lips.

4. A frame member according to claim 1, wherein said wall portion forms part of an inwards facing side wall of a channel for a sliding sash, and wherein the slot obtained by removal of said web is suitable for retaining a weather sealing member for engaging a sash in said channel.

5. A frame member according to claim 1, wherein said wall portion is provided at a surface which forms the outer or inner side face of a window frame, and such that the slot obtained by removal of the web is suitable for retaining a projecting rib part of an auxiliary frame member.

6. A frame member having a main body part which, in cross-section, is of hollow, elongated, rectangular form the end surfaces of which constitute outer and inner side faces of a window frame, and wherein said frame member includes a wall portion in accordance with claim 1 at each of said end surfaces.

* * * * *